US007614189B2

(12) United States Patent
Smerud et al.

(10) Patent No.: US 7,614,189 B2
(45) Date of Patent: Nov. 10, 2009

(54) ARCHED MEMBER AND METHOD OF MANUFACTURE, SHIPPING, AND INSTALLATION OF SAME

(75) Inventors: Richard J. Smerud, 3667 Camino Marglesa, Escondido, CA (US) 92065; J. Miguel Arvizu, Escondido, CA (US)

(73) Assignee: Richard J. Smerud, Escondido, CA (US)

( * ) Notice: Subject to any disclaimer, the term of this patent is extended or adjusted under 35 U.S.C. 154(b) by 906 days.

(21) Appl. No.: 11/045,201

(22) Filed: Jan. 27, 2005

(65) Prior Publication Data

US 2006/0174550 A1 Aug. 10, 2006

(51) Int. Cl.
*E06B 1/04* (2006.01)
*E06B 1/24* (2006.01)
*E04B 1/32* (2006.01)

(52) U.S. Cl. ..... 52/211; 52/85; 52/86; 52/88; 52/210; 52/80.1

(58) Field of Classification Search ..... 52/211, 52/85, 86, 88, 80.1, 210, 204.1, 204.2, 245, 52/329
See application file for complete search history.

(56) References Cited

U.S. PATENT DOCUMENTS

| | | | | | |
|---|---|---|---|---|---|
| 391,463 | A | * | 10/1888 | Ellis | 14/24 |
| 1,149,965 | A | | 8/1915 | Stokes | |
| 1,346,161 | A | | 7/1920 | Basquin | |
| 2,642,162 | A | | 6/1953 | Tobias | |
| 3,008,272 | A | | 11/1961 | Widin | |
| 3,159,251 | A | | 12/1964 | Becker | |
| 4,379,376 | A | | 4/1983 | Adell | |
| 4,676,045 | A | | 6/1987 | Ellen | |
| 4,907,383 | A | * | 3/1990 | Winter, IV | 52/86 |
| 4,955,168 | A | * | 9/1990 | Barry | 52/210 |
| 5,232,762 | A | | 8/1993 | Ruby | |
| 5,245,802 | A | * | 9/1993 | Davis | 52/86 |
| 5,417,027 | A | | 5/1995 | Wagenet | |
| 5,572,834 | A | * | 11/1996 | Lilly | 52/85 |
| 5,584,148 | A | | 12/1996 | Barry et al. | |
| 5,618,601 | A | | 4/1997 | Ruby | |
| 5,671,583 | A | * | 9/1997 | Turner | 52/745.16 |
| 5,699,638 | A | | 12/1997 | Maylon | |
| 5,824,382 | A | | 10/1998 | Ruby | |
| 6,128,864 | A | | 10/2000 | Barry et al. | |
| 6,401,405 | B1 | | 6/2002 | Hicks | |

(Continued)

*Primary Examiner*—Richard E Chilcot, Jr.
*Assistant Examiner*—Mark R Wendell
(74) *Attorney, Agent, or Firm*—Gordon & Rees, LLP

(57) ABSTRACT

An arched member such as a jamb is made from three parts. The first part is an elongate strip having upper and lower faces, opposite sides, and opposite first and second ends, with elongate grooves extending along the opposite sides. The other parts are a pair of elongate side pieces each slidably engaged in a respective one of the grooves. The strip and side pieces are formed together into an arch having a predetermined curvature with the opposite ends of the side pieces flush with the opposite ends of the strip. The formed member is sufficiently flexible to enable it to be forced into a flat condition for shipping. When forced flat, at least one end of each side piece will project out from the respective end of the strip. The projecting ends provide indicators to allow a user to correct the curvature of the member after release from the flat condition.

10 Claims, 9 Drawing Sheets

U.S. PATENT DOCUMENTS

| | | | | |
|---|---|---|---|---|
| 6,408,576 | B1 | 6/2002 | Roth | |
| 6,647,673 | B2 | 11/2003 | Smerud | |
| 6,898,903 | B1 * | 5/2005 | Thomas | 52/86 |
| 7,562,497 | B2 * | 7/2009 | Warren | 52/86 |
| 2004/0000102 | A1 | 1/2004 | Smerud | |
| 2004/0187403 | A1 * | 9/2004 | Hauck | 52/80.1 |

* cited by examiner

ARCHED MEMBER AND METHOD OF MANUFACTURE, SHIPPING, AND INSTALLATION OF SAME

BACKGROUND OF THE INVENTION

The present invention relates generally to manufacture and installation of arches or members of predetermined curvature, and is particularly concerned with arched jamb members for the top of an arched wall opening of an arched window or doorway.

Co-pending application Ser. No. 10/187,131 of Smerud describes an arched jamb member or strip which is formed into an arch of predetermined radius of curvature, but which is sufficiently flexible to be forced flat for shipping and storage purposes. The jamb member may have a plurality of transverse kerfs or grooves across its upper face for added flexibility.

With this arrangement, the strip will spring back into a curved condition when released from its packaging, ready for installation. However, since it has some flexibility, the installer may have some difficulty in maintaining the correct curvature for matching the upper curved edge of a door to be fitted in the doorway.

SUMMARY OF THE INVENTION

It is an object of the invention to provide a new and improved arched member which can be stored flat and which will adopt a desired radius of curvature when released.

It is a further object of the invention to provide a new and improved method of manufacturing an arched member which can be stored and shipped in a flat condition.

According to one aspect of the present invention, an arched member is provided, which comprises an elongate strip having upper and lower faces, opposite side edges, and opposite ends, elongate grooves extending along opposite side edges between the opposite ends of the strip, and a pair of elongate side pieces each slidably engaged in a respective one of the grooves, each side piece having opposite ends, the strip and side pieces together being formed into an arch having a predetermined curvature with the opposite ends of the side pieces flush with the opposite ends of the strip, and the strip and side pieces being of sufficient flexibility to enable them to be forced into a flat condition for shipping and storage purposes, whereby at least one end of each side piece will project out from the respective end of the strip when the strip and side pieces are forced into the flat condition.

With this arrangement, when the arched member is released from the flat condition, both the strip and the side pieces together will spring back into the arched condition. The side pieces add rigidity and help the jamb or arched member to spring back from the flattened condition into an arched condition. The installer can easily determine when the parts are at the correct curvature, since the ends of the side pieces will then be flush with the end or ends of the strip. In one embodiment, the side pieces are each secured to the strip at one end so that they will protrude out from the opposite end only when the assembly is forced flat. The grooves in the opposite sides of the strip may have at least a portion of dovetail cross-sectional shape, with the side pieces having a corresponding portion of dovetail shape to retain them in the grooves in the transverse direction, while permitting sliding motion in an axial direction along each groove.

The upper face of the strip may have a series of spaced, transverse kerfs extending along at least a major part of the length of the strip, for increased flexibility. Each side groove may have a portion extending up to the upper face of the strip to form an indent at each side of the upper face, with the side pieces being of shape matching that of the respective groove and indent. A portion of each side piece will therefore extend up flush with the upper face of the strip to fill the indent.

The arched member may be used for any application where formation of a curve of predetermined radius of curvature is required. One possible application is as an arched jamb member for the upper end of an arched wall opening such as a window or doorway. In this application, opposite ends of the arched member are shaped to engage in matching indents at the upper ends of a pair of upright jamb members, forming a doorway frame. The projecting ends of the side pieces when the member is flattened from the predetermined curvature provide visible indicators to a user that the curvature requires adjustments.

According to another aspect of the present invention, a method of making an arched member of predetermined curvature is provided, which comprises the steps of taking a flat strip of flexible material having an upper face, a lower face, opposite side edges, and opposite ends, machining the opposite side edges of the strip to form grooves extending along the opposite side edges between the opposite ends of the strip; forming a pair of elongate side pieces for sliding engagement in the respective grooves; slidably engaging the side pieces in the respective grooves with the opposite ends of the side pieces flush with the opposite ends of the strip; forming the strip and side pieces together into an arched configuration of predetermined curvature; and cutting the opposite ends of the strip and side pieces to form flush cut end faces while holding the strip and side pieces in the predetermined arched configuration.

This method of manufacture ensures that the ends of the side pieces will only be flush with the corresponding ends of the strip when the member is in the predetermined arched configuration. If the member is flattened, at least one end of each side piece will project outwardly from the corresponding end of the strip. In an exemplary embodiment, one end of each side piece is secured to the corresponding end of the strip by nails or the like, so that the side pieces only project out at one end when the member is flattened from the predetermined arched configuration.

According to another aspect of the present invention, a method of shipping and installation of an arched jamb member is provided, which comprises the steps of providing an elongate strip member which is pre-formed into an arched shape of predetermined curvature and which is of predetermined flexibility, the strip member having elongate grooves extending along each side edge, and an elongate side piece slidably engaged in each groove with opposite ends flush with the opposite ends of the strip member when in the predetermined arched shape, the side pieces also being formed of flexible material, forcing the arched strip member and side pieces into a flat condition in which at least one end of each side piece projects outwardly from the corresponding end of the strip member, placing the flattened strip member and side pieces into a flat packaging container and constraining it in the flat condition in the container, transporting the flattened strip member and side pieces in the container to an installation location, releasing the flattened strip member and side pieces from the container such that the strip member and side pieces spring back into an arched shape, and adjusting the curvature of the arched shape until the ends of the side pieces are flush with the respective end of the strip member prior to installation of the entire assembly at the top of an arched wall opening.

This arrangement allows the installer to ensure that the arched jamb member will have the correct curvature or arched shape when installed at the top of the wall opening. The installer simply adjusts the curvature during installation until the ends of the side pieces are matched with the end or ends of the strip member, and then secures the arched member in the wall opening.

The arched jamb member and method of this invention allows storage and shipping in a flat container of relatively small dimensions, and at the same time provides the installer with a convenient means for ensuring proper installation. The top of the arched opening will therefore reliably match the upper end of the installed window or door, reducing the risk of binding or jamming.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
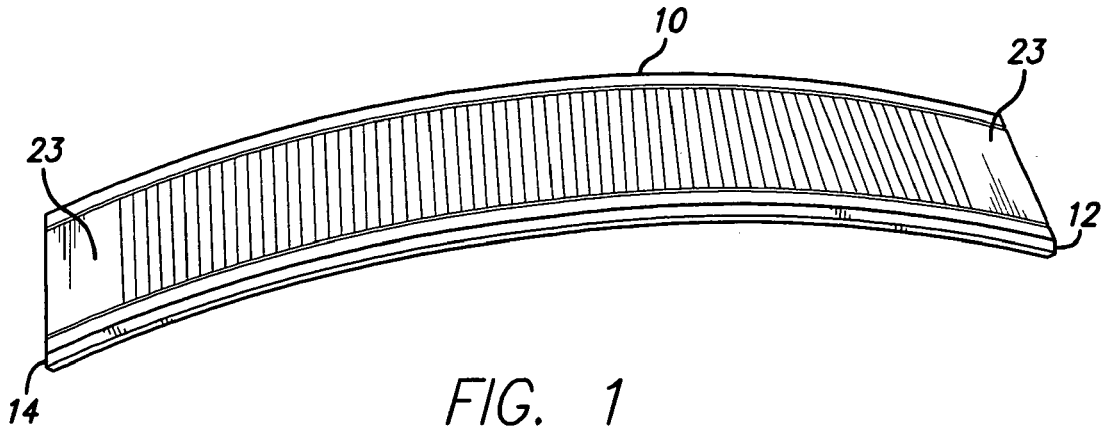
FIG. 1 is a top perspective view of an arched jamb member according to an exemplary embodiment of the invention.
Figure 1A:
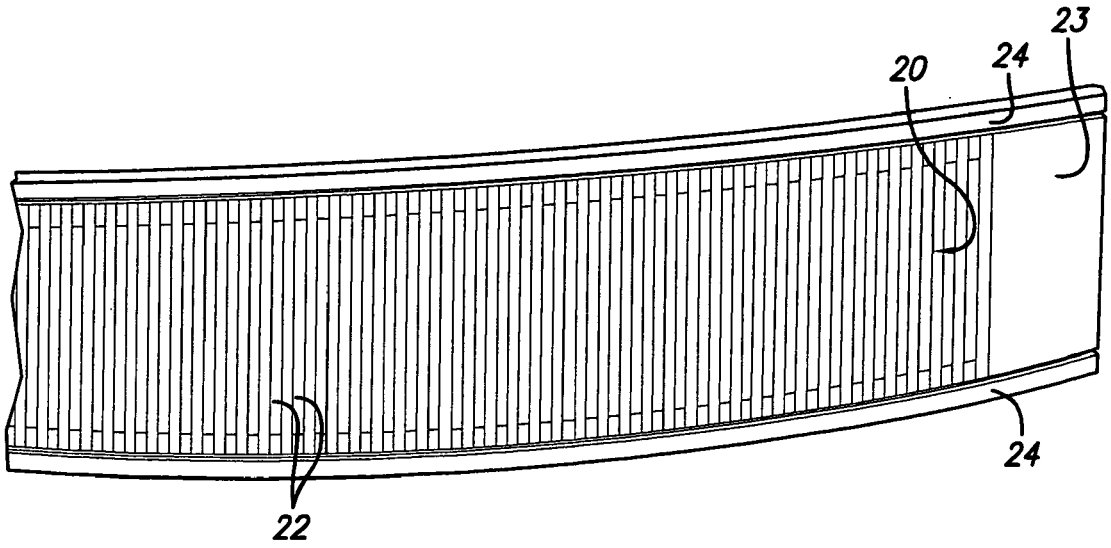
FIG. 1A is a partial top plan view of the jamb member on a larger scale than FIG. 1, illustrating one end of the jamb member.
Figure 2:
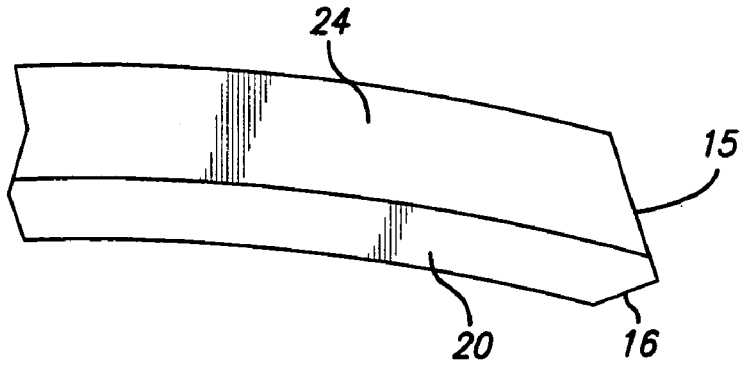
FIG. 2 is a side elevation view of one end of the jamb member on an enlarged scale.
Figure 3:
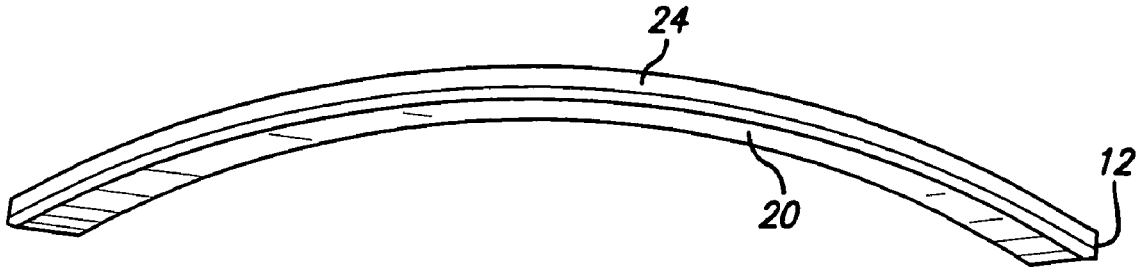
FIG. 3 is a bottom perspective view of the jamb member of FIGS. 1, 1A and 2.
Figure 4:
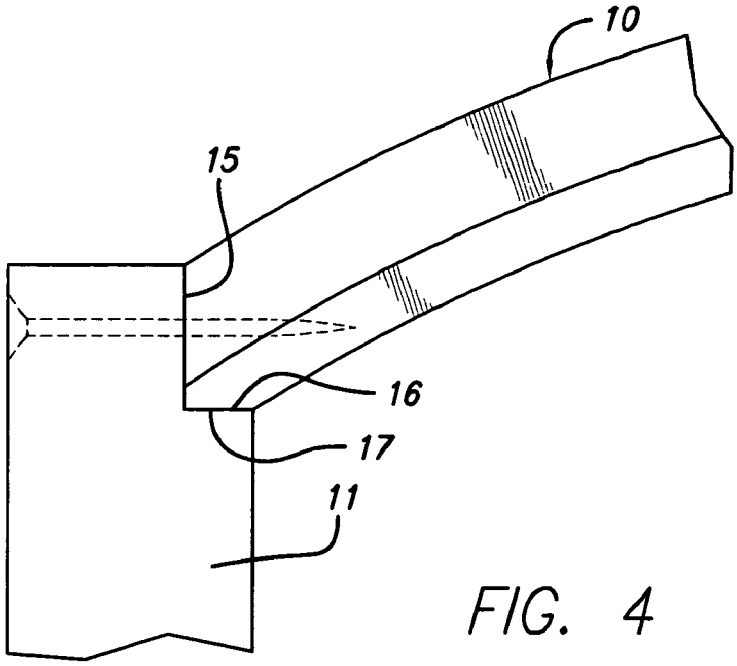
FIG. 4 is a front view of one side of a jamb assembly at the junction between the upper end of an upright jamb and one end of the arched jamb member of FIGS. 1 to 3.
Figure 5:
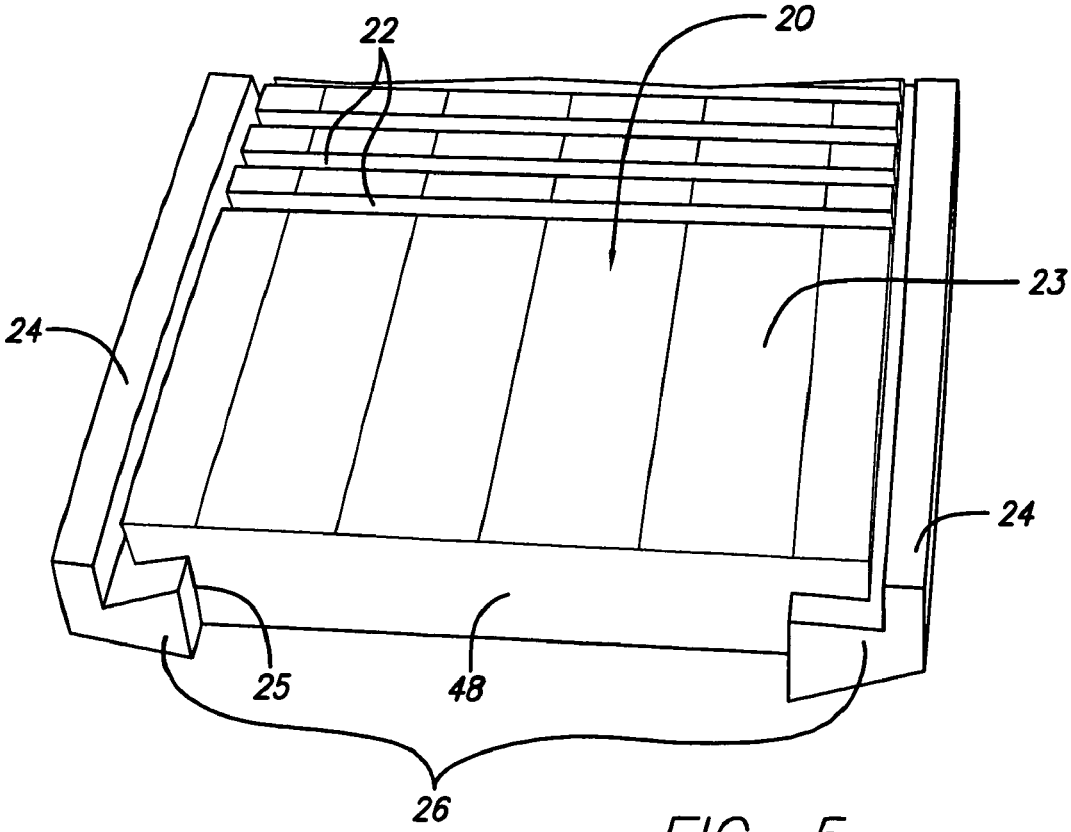
FIG. 5 is a perspective view of one end of the jamb member in a flattened condition.
Figure 6:
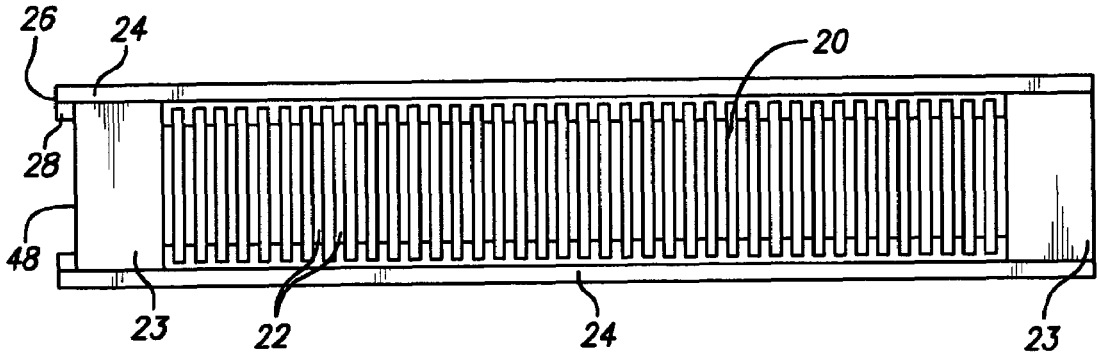
FIG. 6 is a top plan view of the jamb member in the flattened condition.
Figure 7:
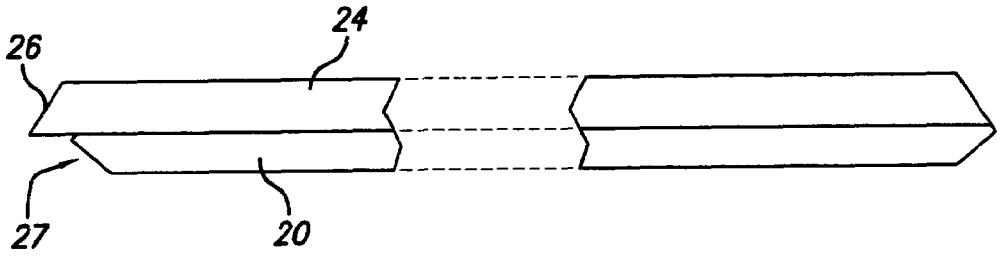
FIG. 7 is a side elevation view of the jamb member in the flattened condition.
Figure 8:
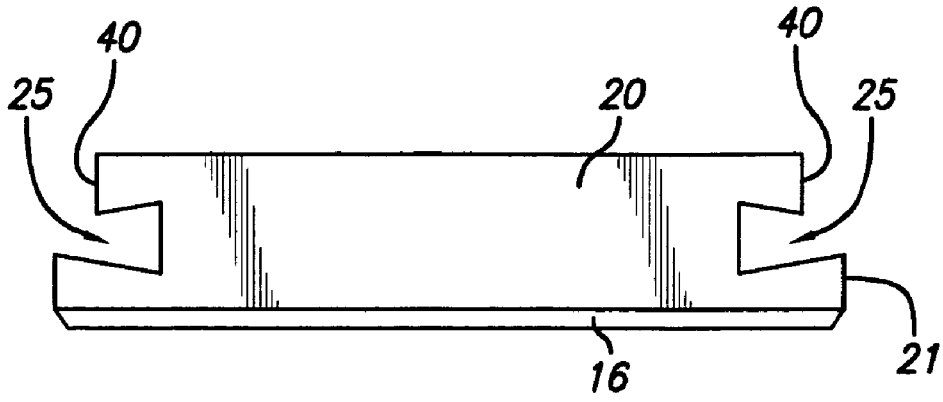
FIG. 8 is an end elevation view of the elongate strip with the side pieces removed.
Figure 9:
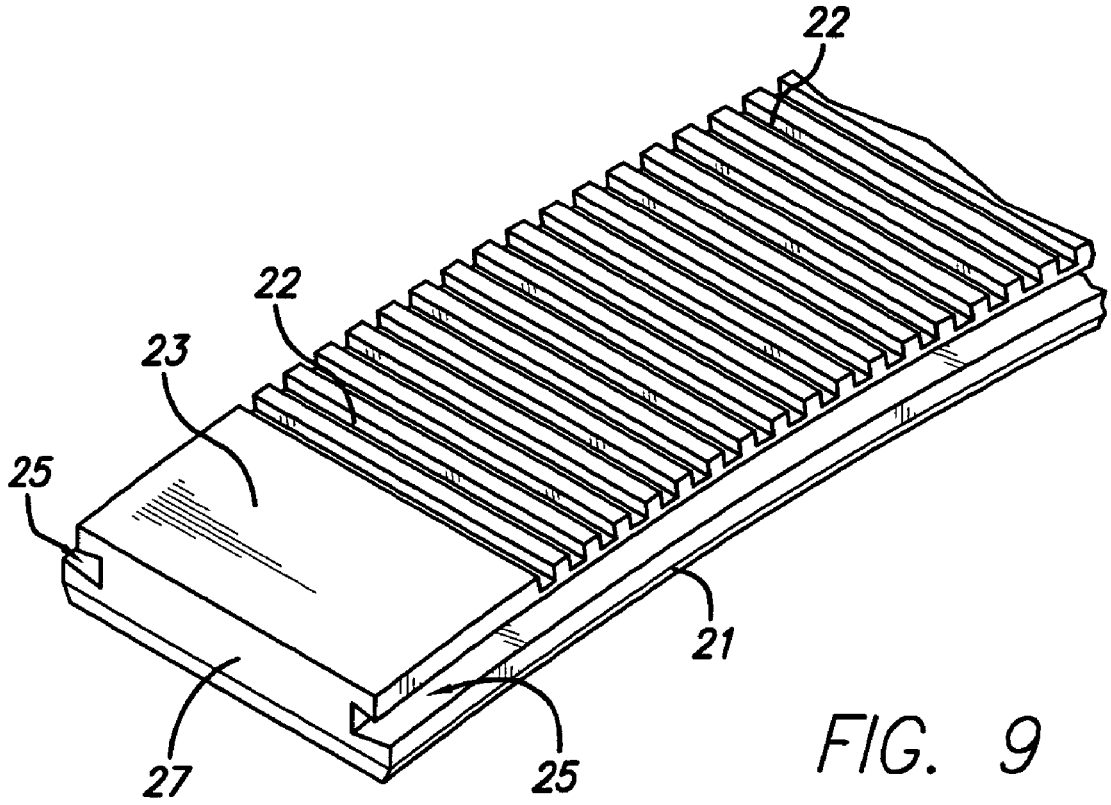
FIG. 9 is a partial top perspective view illustrating one end of the strip as in FIG. 8 with the side pieces or runners removed.
Figure 10:
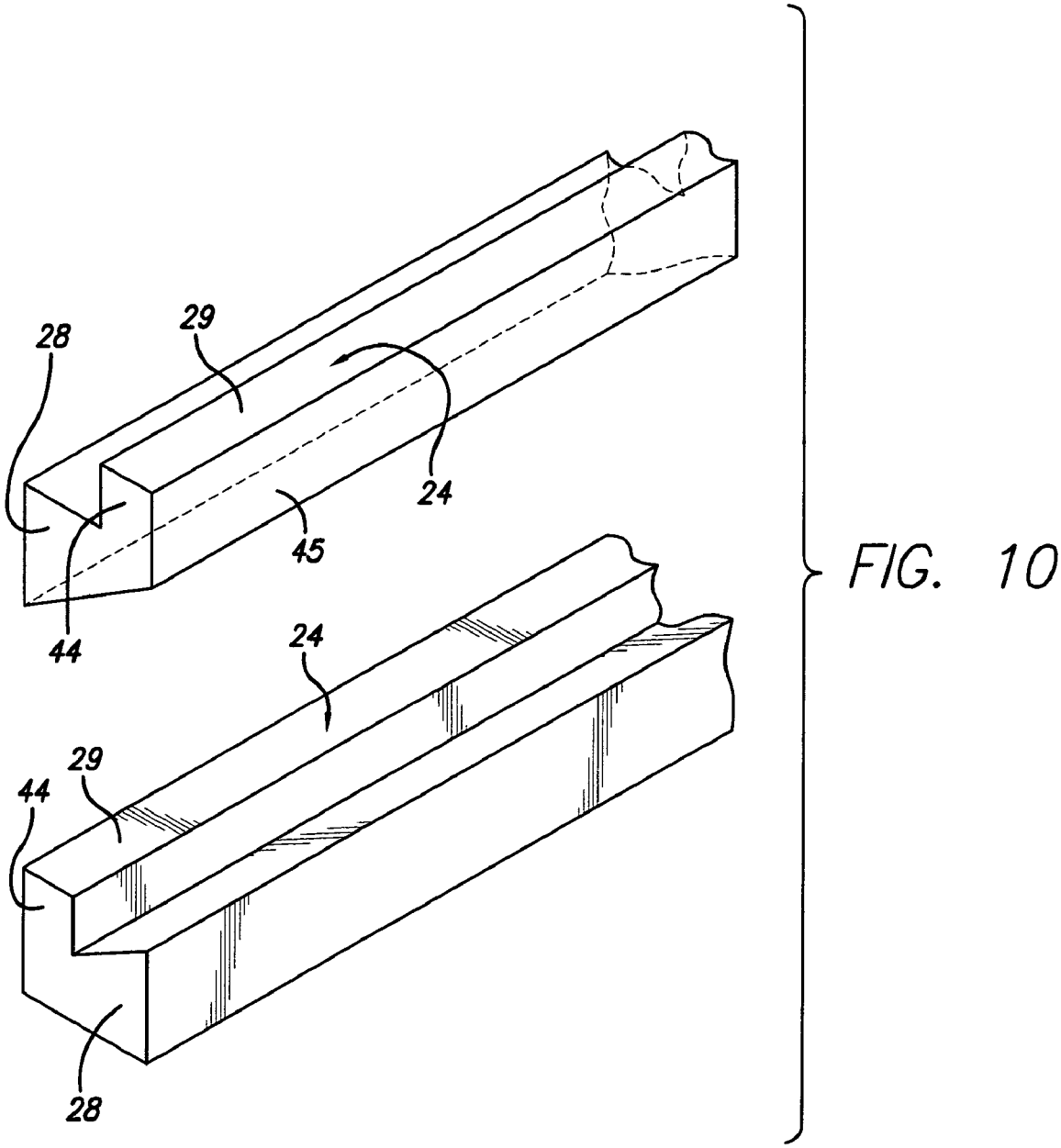
FIG. 10 is a perspective partial view of the two runners on a larger scale than FIGS. 8 and 9.

FIGS. 1 to 3 of the drawings illustrate an assembled arched jamb member 10 according to an exemplary embodiment of the present invention in the desired arched configuration. FIG. 4 illustrates an installation with one end of the jamb member 10 attached to the upper end of an upright jamb member 11 with a fastener screw 13 or the like. FIGS. 5 to 7 illustrate the jamb member 10 in a flattened condition for shipping purposes, and FIGS. 8 to 10 illustrate the separate components of the jamb member 10.

The jamb member 10 is of predetermined length, curvature and radius of curvature, depending on the desired arch dimensions and shape at the top of an arched opening for a door or window. The jamb member will be installed across the top of the arched opening in a wall, with its opposite ends 12,14 engaging in angled cut-outs 17 at the upper ends of the upright jamb members 11 which frame the opposite sides of the opening. As in co-pending application Ser. No. 10/187,131 filed Jun. 28, 2002, the contents of which are incorporated herein by reference, the opposite ends 12,14 of the jamb member have angled cuts 15,16 defining a ninety degree angle and designed for mating engagement in the respective angled cut-outs 17 at the upper ends of the upright jamb members, as best illustrated in FIGS. 2 and 4.

Jamb member 10 is made in three parts. The first part comprises an elongate strip member 20 of plastic or other flexible material, as best illustrated in FIGS. 8 and 9, and the second and third parts comprise a pair of identical elongate runners or side pieces 24, as illustrated in FIG. 10, which are slidably engaged in elongate dovetail slots or grooves 25 extending along opposite sides of the strip member 20. The runners 24 are also of flexible plastic or other flexible material. The strip member 20 and runners 24 may be of any flexible material of suitable strength and durability, such as paint grade plastic material, wood, laminate, or composite material, or combinations thereof.

The elongate strip member has a series of grooves or kerfs 22 extending transversely across its upper surface between the opposite side faces 21 of the member to define spaced parallel ribs. The kerfed region terminates short of the opposite ends of the strip member to leave a non-kerfed region 23 at each end of the upper face, as best illustrated in FIGS. 1 and 9. The non-kerfed regions are for nailing or attachment to the cut-outs in the upright jamb members on installation in a wall opening. The elongate dovetail slots or grooves 25 extend along the entire length of the strip member between its opposite end faces 12 and 14. The shape of the grooves is best illustrated in FIGS. 8 and 9. As seen in FIG. 8, each groove 25 is of dovetail shape and is cut or machined into the respective side face 21 of the strip member. An indent is formed on each side of the upper face of the strip member 20, so that the strip member has a central portion of a first thickness and opposite side portions of reduced thickness. The dovetail grooves or slots 25 project inwardly from each indent 40.

Figure 11:
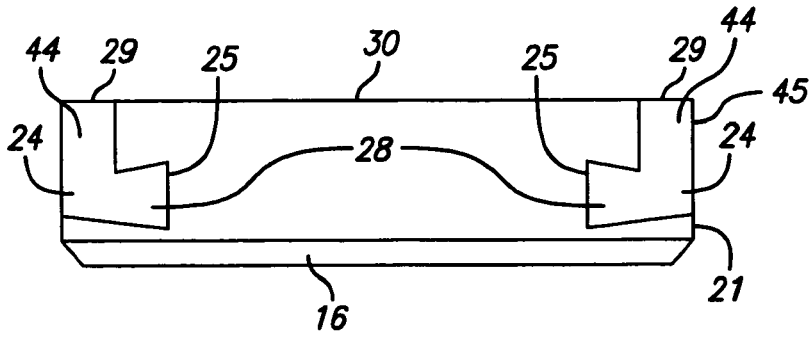
FIG. 11 is an end elevation view of the strip with the runners engaged in the grooves on opposite sides of the strip.

FIG. 10 illustrates the two side pieces or runners 24 for sliding engagement in the respective grooves 25, with the runners 24 shown on an enlarged scale relative to FIGS. 8 and 9, and partially broken away. Each runner is of shape substantially matching the contoured shape of the cut out 40 and groove 25 in which it is to be engaged, and with dimensions slightly less than those of the groove so that it can be slidably engaged in the groove. Each runner 24 is generally L-shaped, with an upper or upright portion 44 for fitting in indent 40 and a dovetail portion 28 projecting to one side of the upright portion 44. When the two runners 24 are slidably engaged in the respective grooves 25, they will fill the indent and groove in each side of the strip member 20, as best illustrated in FIG. 11, with the upper face 29 of upright portion 44 flush with the upper face 30 of the strip member, and the outer face 45 of the portion 44 flush with the outer side face 21 of the strip member. The arrangement is such that, when the runners 24 are engaged in the grooves and the three piece arched jamb member is in the predetermined arched configuration, the opposite end faces 26 of the runners 24 are flush with the opposite end faces 48 of the strip member, as illustrated in FIGS. 1 and 2.

The runners 24 may be nailed or otherwise secured to the strip member at one end. Because of the inherent flexibility of the strip member 20 and side pieces or runners 24, as well as the kerfs 22 which increase the flexibility of member 20, the jamb member 10 is sufficiently flexible to enable it to be forced into a flat condition, as indicated in FIGS. 6 and 7. It can then be packed into a flat container which will hold it in the flat condition for storage and shipping purposes. Since the free ends 26 of the runners 24 are flush with the respective end of the strip member when the jamb member is in the desired arched configuration, they will project out from the end of the strip member when the jamb member is forced flat, as indicated in FIGS. 6 and 7.

The projecting ends 26 of the runners provide a visible indicator to the installer which enables them to readily ensure that the arched jamb member 10 is in the correct arched configuration for installation in an arched wall opening. When the jamb member arrives at the installation location, it is removed from its container and will spring back into a generally arched configuration. The side pieces or runners will provide increased rigidity when the member is in the arched configuration, as well as helping it to spring back into the desired arched shape. If there is any remaining end portion of the runners projecting outwardly from the corresponding end face 48 of the strip member, the installer will know that they must bend the member a little more until the end faces 26 and 48 are flush, and they can then accurately install the jamb member between the upper ends of the two upright jamb members 11. It will also be evident if the jamb member is curved too much since the end faces 26 will then be indented from the end face 48 of the strip member. The installer simply has to adjust the curvature of the jamb member until the end faces 26 and 48 are flush. This will help to ensure that the curvature of the upper jamb member is a relatively accurate match to the curvature at the top of the door or window, and will make the installation much easier.

Figure 12:
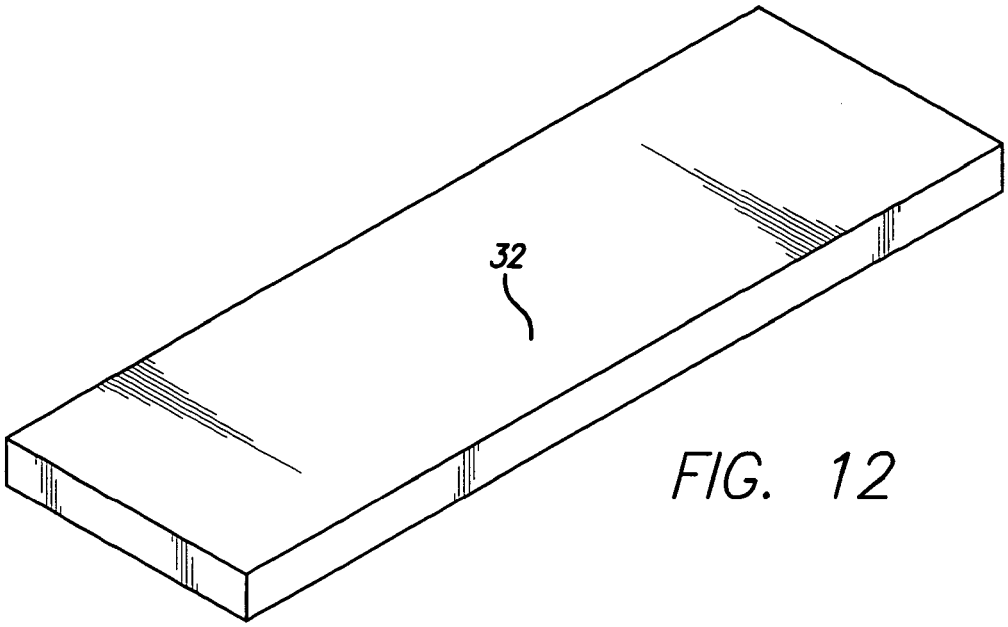
FIG. 12 is a top perspective view of a flat strip in the first step of a method of making the arched jamb member of FIGS. 1 to 11.
Figure 13:
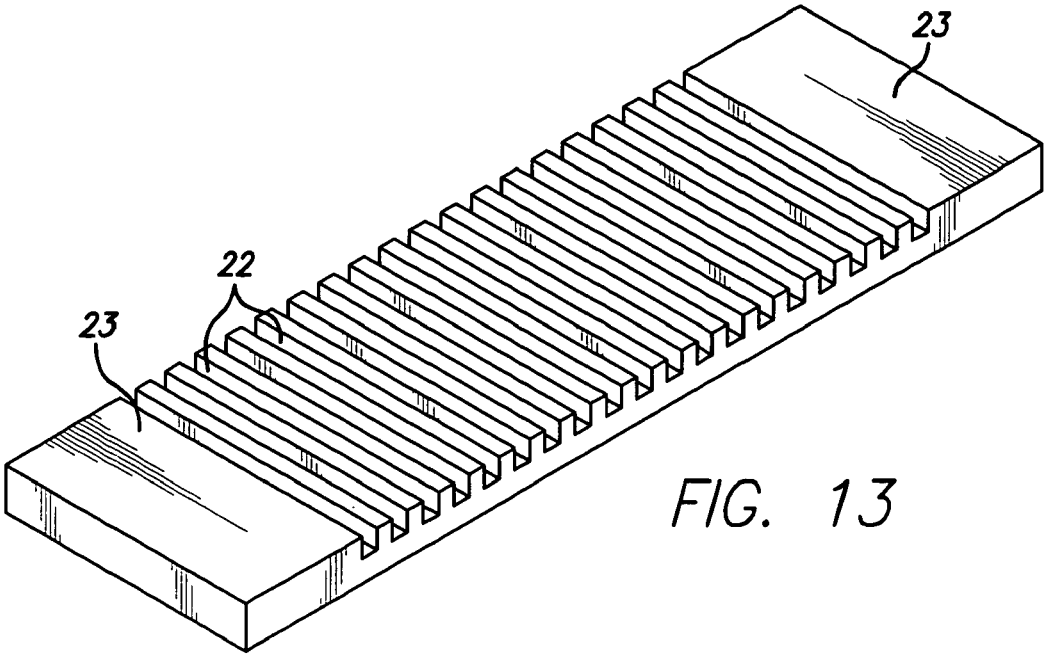
FIG. 13 is a top perspective view similar to FIG. 12 illustrating the next step of the method.
Figure 14:
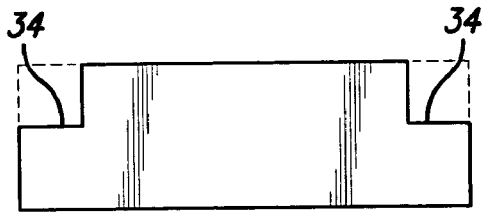
FIG. 14 is an end elevation view illustrating the next step of the method.
Figure 15:
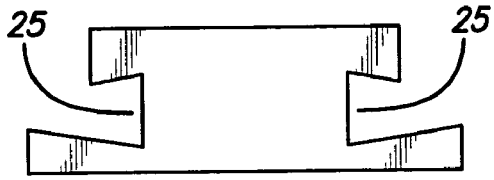
FIG. 15 is an end elevation view illustrating final machining of the dovetail slots or grooves.
Figure 16:
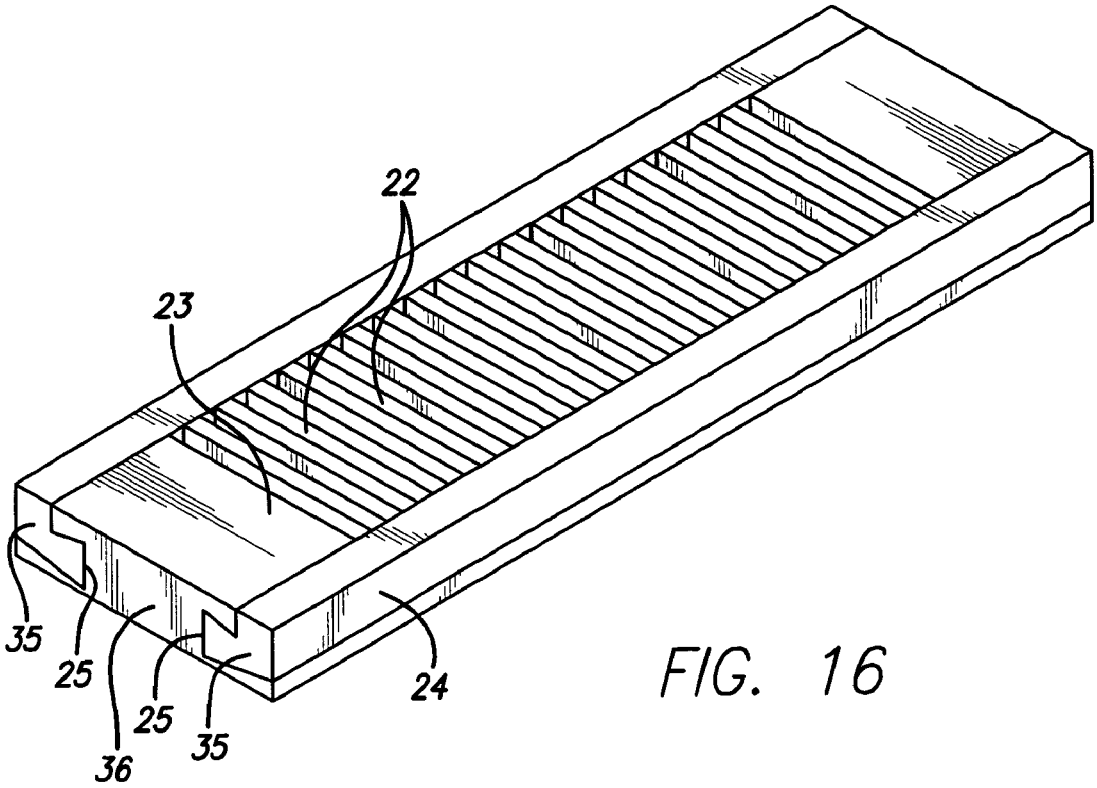
FIG. 16 is a top perspective view illustrating the side pieces or runners engaged in the strip in the next step of the method.

FIGS. 12 to 18 illustrate one possible method of manufacturing the arched jamb member 10 of FIGS. 1 to 11. In the first step, a flat strip 32 of suitable flexible material is cut to the desired length, as indicated in FIG. 12. Parallel kerfs 22 are then cut at spaced intervals across the upper face of the strip 32, terminating short of the end portions 23 which are to remain flat and non-kerfed, as illustrated in FIG. 13. In the next step, as illustrated in FIG. 14, indents 34 are cut in the opposite sides of the strip 32 to the full depth of the kerfs, so that the ends of the ribs between kerfs 22 are cut off and a smooth rectangular indent is formed. The dovetail grooves 25 are then machined into the opposite side faces of the strip 32, as illustrated in FIG. 15. The side pieces or runners 24 are then machined and inserted into the dovetail slots and indents along opposite sides of the strip 32, and cut off if necessary so that the end faces 50 of the runners 24 are flush with the flat end faces 52 of the strip 32, as illustrated in FIG. 16. The runners 24 are secured to the strip 32 at one end with nails or the like.

Figure 17:
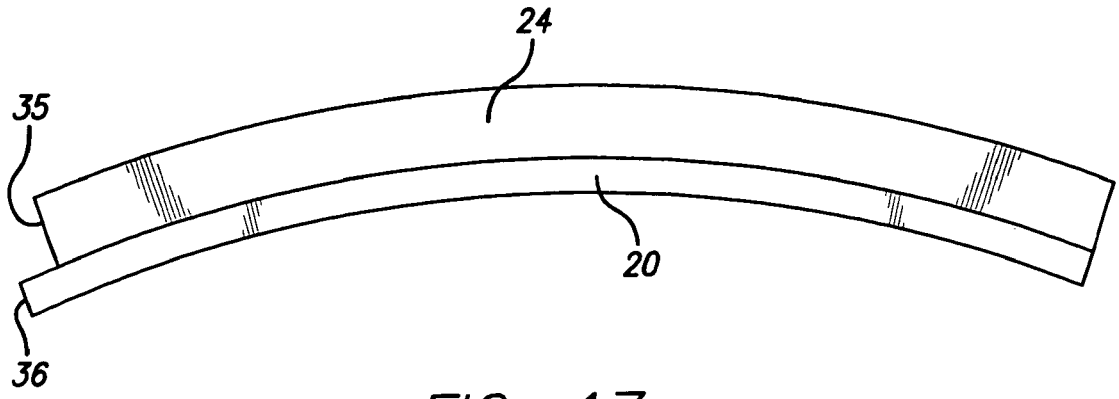
FIG. 17 is a side elevation view illustrating the step of bending the assembled strip and runners to the desired arched configuration.
Figure 18:
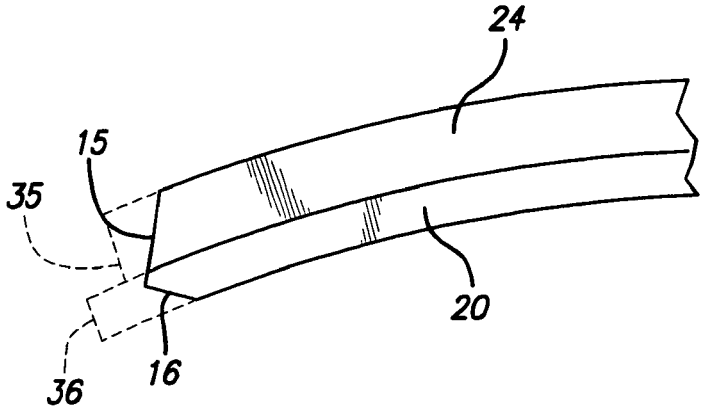
FIG. 18 is a broken away side elevation view of one end of the assembly of FIG. 17 illustrating the final step of the method.

In the next step, as illustrated in FIG. 17, the assembled strip and runners are heated and bent into an arched shape of the desired radius of curvature, depending on the installation requirements. This will result in flat end faces 50 of the free ends of the runners 24 being offset from the corresponding flat end face 52 of the strip, as indicated in FIG. 17. While maintaining the desired arched configuration, the opposite ends of the assembly are then cut to provide the desired end cuts 15,16, as illustrated in FIG. 18, cutting off the indented free ends of the runners so that the end faces of the runners at both ends are flush with the corresponding end face of the strip. The dotted lines in FIG. 18 indicate the portion which is cut off at the indented end of the assembly.

This method produces an arched member of a predetermined curvature which has a built-in indicator for showing if the member is flattened or bent so as to change the curvature. It will be very easy for the user to modify the curvature until the ends of the runners are again flush with the end face of the strip. Although the embodiment described above is particularly intended for use as an upper jamb member for an arched wall opening for forming a window or doorway, there are other applications where such a device may be useful. This invention may be used in manufacturing any product in which an arched member or wall of predetermined curvature is required.

As noted above, the arched member of this invention is particularly useful in installation of arched doorways or windows. The flexibility of the member allows it to be flattened and stored in a flat profile container for storage and shipping purposes, reducing storage and shipping costs. At the same time, the curvature indicator provided by the ends of the side pieces or runners will allow an installer on site to readily adjust the member until it is at the desired radius of curvature prior to installation at the upper end of the arched wall opening. This will help to ensure that the arched upper jamb member is an accurate match with the arched upper edge of a window or door installed in the opening.

Although an exemplary embodiment of the invention has been described above by way of example only, it will be understood by those skilled in the field that modifications may be made to the disclosed embodiment without departing from the scope of the invention, which is defined by the appended claims.

We claim:

1. An arched jamb member, comprising:

an elongate strip having upper and lower faces, opposite side edges, and opposite first and second ends;

the strip having elongate grooves extending along opposite side edges between the opposite ends of the strip;

a pair of elongate side pieces each engaged in a respective one of the grooves, each side piece having opposite first and second ends, the first ends of the side pieces being secured to the first end of the elongate strip, the second ends of the side pieces being slidably engaged in the grooves; and the jamb member being flexible between a flat configuration with the second ends of the side pieces extending beyond the second end of the elongate strip and an arched configuration of predetermined curvature with the second ends of the side pieces flush with the second end of the elongate strip.

2. The arched jamb member of claim 1, wherein the grooves in the opposite sides of the strip have at least a portion of dovetail cross-sectional shape, and the side pieces have a corresponding portion of dovetail shape slidably engaged in the dovetail portion of the respective grooves, whereby the side pieces are retained in the grooves in the transverse direction, while permitting sliding motion in an axial direction along each groove.

3. The arched jamb member of claim 1, wherein the upper face of the strip has a row of spaced, transverse kerfs extending along at least a major part of the length of the strip.

4. The arched jamb member of claim 3, wherein the upper face of the strip has end portions of predetermined dimensions which have no kerfs, the row of kerfs extending between the end portions.

5. The arched jamb member of claim 2, wherein each side groove has a portion extending up to the upper face of the strip to form an indent at each side of the upper face, and each side piece has a cross-sectional shape substantially matching that of the respective groove and an upper face which is substantially flush with the upper face of the strip when the side piece is installed in the respective groove.

6. A method of making an arched jamb member of predetermined curvature, comprising the steps of:

providing a flat strip of flexible material having an upper face, a lower face, opposite sides, and opposite ends;

machining the opposite sides of the strip to form grooves extending along the opposite sides between the opposite ends of the strip;

forming a pair of elongate side pieces for sliding engagement in the respective grooves;

slidably engaging the side pieces in the respective grooves with the opposite ends of the side pieces flush with the opposite ends of the strip;

forming the strip and side pieces together into an arched configuration of predetermined curvature; and cutting the opposite ends of the strip and side pieces to form flush cut end faces while holding the strip and side pieces in the predetermined arched configuration so that the jamb member is flexible between a flat configuration with the second ends of the side pieces extending beyond the second end of the elongate strip and the predetermined arched configuration of predetermined curvature with the second ends of the side pieces flush with the second end of the elongate strip.

7. The method of claim 6, including the step of securing one end of each side piece to the corresponding end of the strip prior to forming the strip and side pieces into the arched configuration.

8. The method of claim 6, wherein the step of machining the opposite sides of the strip comprises first forming a downwardly indented region along each side of the strip, whereby the strip has a central region of a first thickness and opposite side regions of reduced thickness, and subsequently forming dovetail grooves extending inwardly from the indented region, and the step of forming the elongate side pieces comprises forming each side piece with a cross-sectional shape and dimensions substantially matching the combined cross-sectional shape and dimensions of the respective groove and indented region, whereby the side piece is a smooth sliding fit in the groove and indented region and has an upper face substantially flush with the upper face of the strip.

9. The method of claim 6, wherein the step of cutting the opposite ends of the strip and side pieces comprises forming angled cuts at the opposite ends of the assembled strip and side pieces, each angled cut having a first face at a first angle and a second face at a second angle of approximately ninety degrees to the first angle.

10. A method of shipping and installation of an arched jamb member, comprising the steps of:

providing an elongate strip member which is pre-formed into an arched shape of predetermined curvature and which is of predetermined flexibility, the strip member having elongate grooves extending along each side edge;

the strip member having an elongate side piece slidably engaged in each groove with a first end of each side secured to a first end of the strip member and an opposite second end of each side piece flush with an opposite second end of the strip member when in the predetermined arched shape, the side pieces being formed of flexible material and pre-formed with the strip member into the predetermined arched shape;

forcing the arched strip member and side pieces into a flat condition in which the second end of each side piece projects beyond the second end of the strip member;

placing the flattened strip member and side pieces into a flat packaging container and constraining it in the flat condition in the container;

transporting the flattened strip member and side pieces in the container to an installation location;

releasing the flattened strip member and side pieces from the container such that the strip member and side pieces spring back into an arched shape; and adjusting the curvature of the arched shape until the second ends of the side pieces are flush with the second end of the strip member prior to installation of the arched jamb member at the top of an arched wall opening.

* * * * *

UNITED STATES PATENT AND TRADEMARK OFFICE

CERTIFICATE OF CORRECTION

PATENT NO. : 7,614,189 B2
APPLICATION NO. : 11/045201
DATED : November 10, 2009
INVENTOR(S) : Smerud et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1291 days.

Signed and Sealed this

Nineteenth Day of October, 2010

David J. Kappos

David J. Kappos
*Director of the United States Patent and Trademark Office*